US011421638B2

(12) United States Patent
Schoefbaenker et al.

(10) Patent No.: US 11,421,638 B2
(45) Date of Patent: Aug. 23, 2022

(54) INJECTOR

(71) Applicant: LIEBHERR-COMPONENTS DEGGENDORF GMBH, Deggendorf (DE)

(72) Inventors: Norbert Schoefbaenker, Ohlsdorf (AT); Verena Koegel, Ortenburg (DE); Richard Pirkl, Regensburg (DE); Bernhard Kopp, Villingen Schwenningen (DE)

(73) Assignee: LIEBHERR-COMPONENTS DEGGENDORF GMBH, Deggendorf (DE)

( * ) Notice: Subject to any disclaimer, the term of this patent is extended or adjusted under 35 U.S.C. 154(b) by 0 days.

(21) Appl. No.: 17/286,419

(22) PCT Filed: Oct. 16, 2019

(86) PCT No.: PCT/EP2019/078043
§ 371 (c)(1),
(2) Date: Apr. 16, 2021

(87) PCT Pub. No.: WO2020/079050
PCT Pub. Date: Apr. 23, 2020

(65) Prior Publication Data

US 2021/0388802 A1 Dec. 16, 2021

(30) Foreign Application Priority Data

Oct. 17, 2018 (DE) ..... 10 2018 125 803.8

(51) Int. Cl.
*F02M 61/10* (2006.01)
*F02M 51/00* (2006.01)
(Continued)

(52) U.S. Cl.
CPC ..... *F02M 61/10* (2013.01); *F02M 51/005* (2013.01); *F02M 51/061* (2013.01); *F02M 61/1886* (2013.01); *F02M 2200/8046* (2013.01)

(58) Field of Classification Search
CPC .... F02M 51/005; F02M 51/061; F02M 61/10; F02M 61/18; F02M 61/1886;
(Continued)

(56) References Cited

U.S. PATENT DOCUMENTS 4,957,085 A * 9/1990 Sverdlin ..... F02M 47/043 123/41.31
2007/0152659 A1* 7/2007 Gurich ..... F02M 59/44 324/207.24
(Continued)

FOREIGN PATENT DOCUMENTS

DE 3445721 A1 7/1985
EP 2224123 A1 9/2010
(Continued)

OTHER PUBLICATIONS

ISA European Patent Office, International Search Report Issued in Application No. PCT/EP2019/078043, dated Jan. 17, 2020, WIPO, 6 pages.

*Primary Examiner* — John Kwon
*Assistant Examiner* — Johnny H Hoang
(74) *Attorney, Agent, or Firm* — McCoy Russell LLP

(57) ABSTRACT

An injector for injecting fuel including an injector housing, a movable nozzle needle with a nozzle needle tip arranged in the injector housing, and a nozzle needle seat for receiving the nozzle needle tip. A contact pairing of the nozzle needle and the nozzle needle seat here represents a mechanical switch that adopts a closed state upon contact of the nozzle needle tip with the nozzle needle seat and an open state upon interruption of the contact. Provision is addition-
(Continued)

ally made that the injector has an input line and an output line for controlling movement of the nozzle needle, the switch has a first connector connected to the input line and a second connector connected to the injector housing, and a resistor connected between the first connector of the switch and the input line.

15 Claims, 3 Drawing Sheets

(51) Int. Cl.
*F02M 51/06* (2006.01)
*F02M 61/18* (2006.01)

(58) Field of Classification Search
CPC ..... F02M 2200/0846; F02M 65/00; F02M 65/005; F02D 41/20; F02D 41/2096; F02D 41/24; F02D 41/2467; F02D 2200/063; F02D 2200/247; F02D 2041/2055; F02D 2041/2058
See application file for complete search history.

(56) References Cited

U.S. PATENT DOCUMENTS

| | | | | |
|---|---|---|---|---|
| 2008/0042624 | A1* | 2/2008 | Augesky | H02N 2/067 320/166 |
| 2016/0252034 | A1* | 9/2016 | Li | F02D 41/2096 239/4 |
| 2017/0211533 | A1 | 7/2017 | Barbier et al. | |
| 2017/0268473 | A1* | 9/2017 | Legrand | F02M 51/005 |
| 2020/0063694 | A1* | 2/2020 | Zimmermann | F02D 41/3005 |
| 2020/0191088 | A1* | 6/2020 | Steininger | F02D 41/40 |
| 2020/0256297 | A1* | 8/2020 | Schoefbaenker | F02M 55/025 |

FOREIGN PATENT DOCUMENTS

| | | | |
|---|---|---|---|
| WO | 2004097210 | A1 | 11/2004 |
| WO | 2006032543 | A1 | 3/2006 |
| WO | 2016012242 | A1 | 1/2016 |
| WO | 2019016380 | A1 | 1/2019 |
| WO | 2019141865 | A1 | 7/2019 |

* cited by examiner

INJECTOR

CROSS REFERENCE TO RELATED APPLICATIONS

The present application is a U.S. National Phase of International Application No. PCT/EP2019/078043 entitled "INJECTOR," and filed on Oct. 16, 2019. International Application No. PCT/EP2019/078043 claims priority to German Patent Application No. 10 2018 125 803.8 filed on Oct. 17, 2018. The entire contents of each of the above-listed applications are hereby incorporated by reference for all purposes.

TECHNICAL FIELD

The present invention relates to an injector that is also called an injection valve.

BACKGROUND AND SUMMARY

Such injectors are typically used in internal combustion engines and as a rule work in accordance with a servo principle in which an actuator is set into motion by application of a voltage and a nozzle needle of the injector is raised from a nozzle needle seat by a hydraulic transmission system, whereby an injection of a highly pressurized fuel into a combustion space takes place. The general active principle of an injector is familiar to the skilled person and will only be partially explained in the present invention. It has been the case in the past that a delayed reaction of the injector to electrical signals was also sufficient to be able to precisely represent the accuracy at the engine with respect to the required untreated emissions. However, an even more exact observation of the injection behavior of the injector is required as part of emission regulations that are becoming stricter, with said injection behavior also being able to be corrected over the total service life of an injector or motor. Injectors do not behave the same despite a precise production and are subject to different fluctuations over their service lives. Coking effects, wear of the nozzle seat at the injection valve, application dependent return counter pressure fluctuations, fluctuating temperatures, and further parameters that are not listed are the reason for this.

All of these influencing variables cannot be removed by measurement and stored as a table in the control device on the production of an injector. There has accordingly been a wish for some time to obtain feedback from an injector to generate conclusions on its switching behavior. Systems can be implemented with the aid of such signals that have a closed control loop and so can remove differences from the ideal case by regulation. It is thus achieved that the emissions and also the performance parameters can be kept constant in a specific range over the service life of an internal combustion engine despite a change at the injection valve, but also despite natural influences that result in a fluctuation of the precision. This is in particular of special advantage with respect to the ever more challenging emission regulations.

A change has therefore been made more recently to use the nozzle needle and the nozzle needle seat as a switch so that a current flowing from the nozzle needle toward the nozzle needle seat is interrupted in a raised state of the nozzle needle.

Since the contact pairing of the nozzle needle and the nozzle needle seat produces a mechanical switch that adopts a closed state on a contact of the nozzle needle tip with the nozzle needle seat and an open state on an interruption of the contact, the actual opening period can be determined in a relatively simple manner with the aid of a differential current measurement.

It is accordingly necessary for the described injector state recognition that a current flows over the switch, formed by the contact pairing of the needle tip and the needle seat, toward the ground potential. The ground potential is here typically formed by the engine block in which the injector is located and in which it is screwed. There is therefore already a connection to ground, starting from the nozzle needle seat, via the outer housing of the injector.

It is problematic here that the current flowing off over the switch may be very large under certain circumstances. There are thus states in the injector in which it is energized, but the switch has not yet closed. This is the case, for example, when the energization has only just begun, but a raising of the needle from its seat has not yet taken place. It can occur in this process that the electronic control unit of the injection system erroneously detects a short circuit even though the detected current is deliberately conducted to ground for a state recognition of the injector. The current flowing off to ground should therefore only have an order of magnitude of some milliamperes so that an erroneous detection of a short circuit that is actually not present is not detected by the control unit.

The problem discussed here is solved by an injector having an injection housing, a movable nozzle needle that is arranged in the injector housing and has a nozzle needle tip, and a nozzle needle seat to receive the nozzle needle tip. A contact pairing of the nozzle needle and the nozzle needle seat here represents a mechanical switch that adopts a closed state on a contact of the nozzle needle tip with the nozzle needle seat and an open state on an interruption of the contact. Provision is additionally made that the injector has an input line and an output line for controlling a movement of the nozzle needle, that the switch has a first connector that is connected to the input line and a second connector that is connected to the injector housing, and a resistor is connected between the first connector of the switch and the input line. The invention is characterized in that the resistor is a high temperature resistor chip.

The use of a high temperature resistor chip as a resistor to limit the current flow with a closed switch is advantageous since such a high temperature resistor chip is compact in construction and has only a very small resistance change on temperature changes.

The high temperature resistor chip is preferably characterized in that its mean power is in the range of 0.10 to 0.12 W in the time period of 500 μs, more preferably in the range of 0.11 to 0.12 W.

The high temperature resistor chip can furthermore have a working temperature range of −55° C. to +300° C. so that it also remains operational at very high temperature fluctuations and/or can have a non-magnetic design. The non-magnetic design ensures that no elements of the injector are influenced in an unwanted manner and that their performance is not impaired.

It is likewise of advantage if the high temperature resistor chip does not comprise any organic elements.

Provision can additionally be made that the input line and the output line are connected to an electromagnet, with the electromagnet preferably effecting a raising of the nozzle needle tip from the nozzle needle seat on application of a current conducted over the input line and the output line. Fuel flows into a combustion space at high pressure with an injector in operation by such a raising.

Provision can be made in accordance with an optional modification of the present invention that the input line and the output line each represent a contact of a coil that is part of an electromagnet.

If a current is allowed to flow through the coil, the magnetic force produced in this process has the effect that the nozzle needle rises from its nozzle seat and that fuel is discharged from the injector. Since the switch accordingly opens, the amount of current flowing back from the coil changes since now a portion of current no longer flows off over the switch.

It can prove to be advantageous in accordance with the invention if the contacts of the coil comprise corrosion resistant stainless steel. This material is particularly resistant to the conditions present in the injector and is in particular not susceptible to fuels that are output through the injector.

Provision can furthermore be made that the high temperature resistor chip is fastened to the input line or to the output line in an electrically. Conductive state by means of contact adhesive or soldering.

In accordance with a further optional further development of the invention, a line running from the high temperature resistor chip to the switch (3) runs in a plastic overmolding of a magnetic coil, with the magnetic coil being configured to set the nozzle needle into motion.

It is thereby ensured in a simple manner that the line is not exposed to any environmental influences. The plastic overmolding accordingly does not only surround a magnetic coil of the injector, but rather also serves as a sheath for a line leading to the switch. This line is typically an intermediate piece that extends from the connector of the input line up to the first connector of the switch, that is, typically the nozzle needle.

In accordance with a preferred embodiment, the resistor can here also be arranged at or in the plastic overmolding. On an arrangement in the interior of the plastic overmolding, it is likewise of advantage that the resistor is then better protected from harmful influences.

Provision can furthermore be made that the injector housing is composed of an electrically conductive material.

Provision can furthermore be made that the injector housing is connected to the ground potential. This is typically done via an engine block with which an injector cooperates during its use in accordance with its intended purpose.

The invention further comprises an internal combustion engine having an injector in accordance with one of the above-discussed variants and having a device in accordance with the above-discussed variants.

A motor vehicle that has the above-defined internal combustion engine is further covered by the invention.

BRIEF DESCRIPTION OF THE FIGURES

Further advantages, details, and features of the present invention will become clear with reference to the following description of the Figures. There are shown.

DETAILED DESCRIPTION

Figure 1:
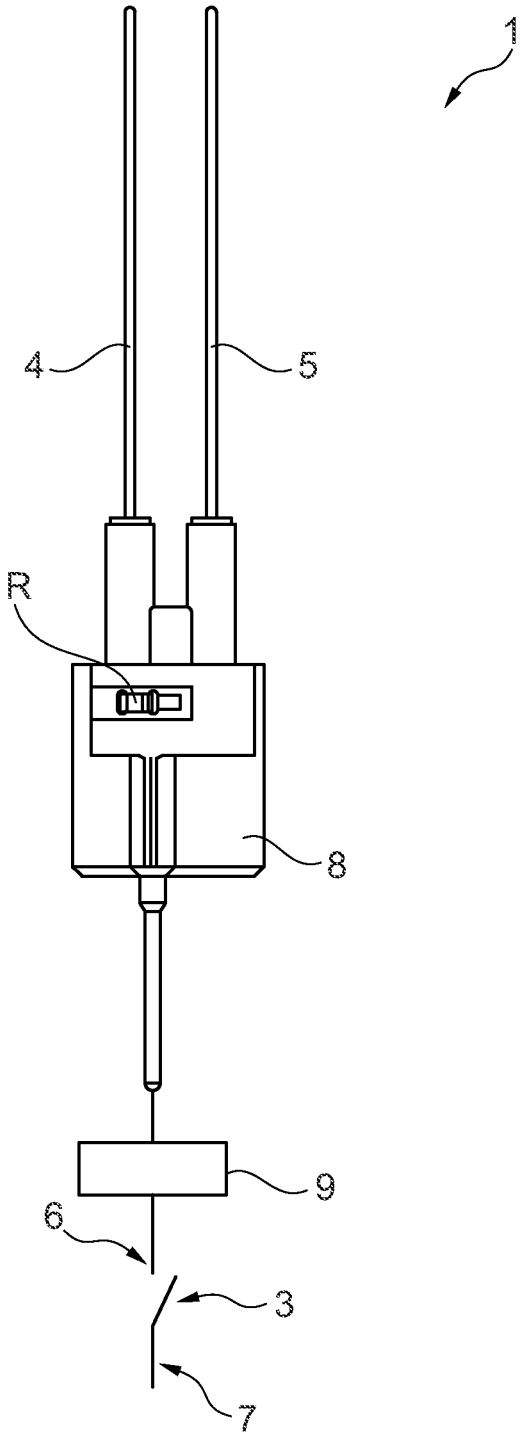
FIG. 1: a selected one of an injector in accordance with the invention.

FIG. 1 shows some parts of an injector 1 in accordance with the invention. The input and output lines 4, 5 can be seen there that correspond to the coil contacts of the coil for the electromagnet on an electromagnetic implementation of the injector 1. The magnetic coil is here surrounded by a fuel overmolding 8 at whose lower end a continuing contact toward the seat plate 9 is arranged. The switch 3 formed of the nozzle needle and the nozzle needle seat that is open or closed in dependence on the state of the injector can be seen from there in a schematic representation. It is not shown in the Figure that the end of the switch remote from the seat plate 9 is connected to ground.

If the switch 3 is in the closed state and if a current flows through the coil, as is, for example, the case at the start of a raising procedure of the needle, a portion of the current flows from the actual circuit of the input and output lines 4, 5 over the resistor R and the switch in the direction of ground potential.

In accordance with the invention, a high temperature resistor chip is provided in the line between a coil contact and the first connector of the switch 3 to limit the height of the outflowing current and simultaneously to keep it at a detectable amount.

Figure 2:
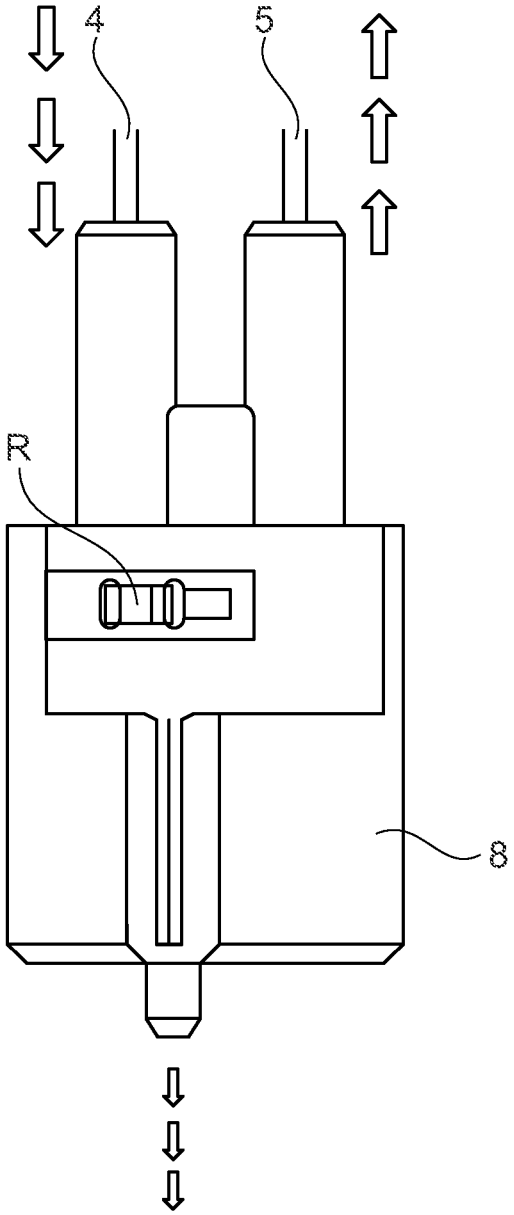
FIG. 2: an enlarged partial view of FIG. 1 with current flows.

FIG. 2 shows an enlarged detail of FIG. 1 and is furthermore provided with current flow arrows. It can be recognized that the current flows from the input line into the electromagnet, more exactly into the winding of the coil of the electromagnet, and then flows back over the output line 5 again. A small amount of current is here taken up by the circuit and flows off over the closed switch. The small amount of current is here marked by smaller arrows.

Figure 3:
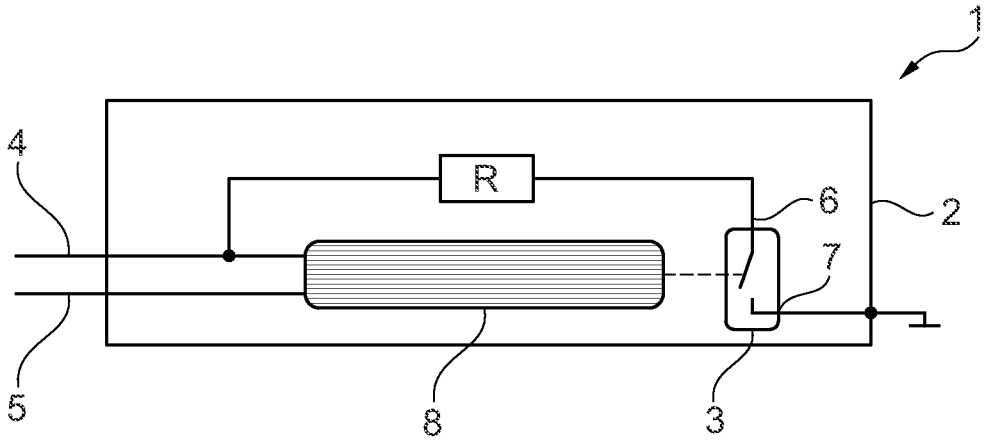
FIG. 3: a schematic sketch of the injector in accordance with the invention.

FIG. 3 shows an embodiment of the injector 1 in accordance with the invention that has an injector housing 2, an input line 4 leading into the injector housing 2, and an output line 5 leading out of the injector housing 2. An actuator 8 that can be an electromagnet, for example, is furthermore provided to control a nozzle needle. The mechanical switch 3 is furthermore also shown there that results from the interaction of the movement of the nozzle needle and of the nozzle needle seat. If the nozzle needle is raised from its seat and if the nozzle is released for injection, the switch 3 is in its open position. In contrast to this, the contact is closed on the closing of the needle and the switch 3 is in its conductive state. A first connector 6 of the switch 3 is here connected to the input line 4 via a resistor R, a high temperature resistor chip in accordance with the invention. The second connector 7 of the switch 3 is electrically connected to the injector housing 2 that is typically to be considered as equivalent to the ground potential 9 in operation.

The information whether the needle lift switch 3 is closed or open and thus whether the injection takes place or not is detected by the current difference of the input line from the output line.

On the activation of the injector, a voltage is applied to the input line and the output line 5 that has the result that the nozzle needle is indirectly set into motion via the actuator 8 that can be designed as an electromagnet. The needle rises from its seat and thus opens the contact. Fuel is injected into the combustion space as a result.

On the use of such an injector, the differential current method (=fault current recognition) can be used for the detection. The current flowing into the injector is compared with the current flowing out in this process. If the switch 3 is closed, a little more current flows into the injector 1 at one of the connectors than over the second connector. This is due to the fact that some of the current flows directly to ground potential 9 over the switch 3. It can thus very easily be detected whether the switch is closed or not.

If, in contrast, the current flowing into the injector is identical to the current flowing out of the injector, the switch 3 is open. If both currents differ, a conclusion on a closed switch 3 can be drawn from this. This kind of detection only works, however, when a voltage is applied to the injector 1 since a current flow is required for the detection.

The invention claimed is:

1. An injector for injecting fuel comprising:

an injector housing;

a movable nozzle needle that is arranged in the injector housing and has a nozzle needle tip; and a nozzle needle seat for receiving the nozzle needle tip, wherein a contact pairing of the nozzle needle and the nozzle needle seat forms a switch that adopts a closed state on a contact of the nozzle needle tip with the nozzle needle seat and an open state on an interruption of the contact;

the injector has an input line and an output line for controlling a movement of the nozzle needle;

a ground connection comprising the switch, a first connector connected to the input line, and a second connector connected to a ground through the injector housing such that current only flows through the ground connection when the switch is closed and the current flow through the ground connection reduces current in the output line; and a resistor is connected between the first connector of the switch and the input line, wherein the resistor is a high temperature resistor chip.

2. The injector in accordance with claim 1, wherein a medium power of the high temperature resistor chip is in a range from 0.10 to 0.12 W.

3. The injector in accordance with claim 1, wherein a working temperature range of the high temperature resistor chip comprises −55° C. to +300° C. so that it also remains operable at very high temperature fluctuations.

4. The injector in accordance with claim 1, wherein the high temperature resistor chip is one or more of: non-magnetic and does not have any organic elements.

5. The injector in accordance with claim 1, wherein the input line and the output line are connected to an electromagnet, and the electromagnet raising the nozzle needle tip from the nozzle needle seat on application of a current conducted over the input line and the output line.

6. The injector in accordance with claim 5, wherein the electromagnet effects a raising of the nozzle needle tip from the nozzle needle seat on application of a current conducted over the input line and the output line.

7. The injector in accordance with claim 1, wherein the input line and the output line each represent a contact of a coil that is part of an electromagnet.

8. The injector in accordance with claim 7, wherein the contacts of the coil consist of a corrosion resistant stainless steel.

9. The injector in accordance with claim 1, wherein the high temperature resistor chip is fastened to is one or more of the input line and output line by contact adhesive or soldering in an electrically conductive state.

10. The injector in accordance with claim 1, wherein a line running from the high temperature resistor chip to the switch runs in a plastic overmolding of a magnetic coil, with the magnetic coil being configured to set the nozzle needle into motion.

11. The injector in accordance with claim 1, wherein the injector housing is composed of an electrically conductive material.

12. A device in accordance with claim 1, wherein the injector housing is connected to a ground potential.

13. The injector in accordance with claim 1, wherein a medium power of the high temperature resistor chip is between 0.11 to 0.12 W in a time period of 500 μs.

14. An internal combustion engine having an injector for injecting fuel, wherein the injector comprises:

an injector housing;

a movable nozzle needle that is arranged in the injector housing and has a nozzle needle tip; and a nozzle needle seat for receiving the nozzle needle tip, wherein a contact pairing of the nozzle needle and the nozzle needle seat forms a switch that adopts a closed state on a contact of the nozzle needle tip with the nozzle needle seat and an open state on an interruption of the contact;

the injector has an input line and an output line connected to an actuator, the actuator controlling movement of the nozzle needle;

a ground connection comprising the switch, a first connector connected to the input line, and a second connector connected to a ground through the injector housing, and the ground connection reducing current in the output line when the switch is closed; and a resistor is connected between the first connector of the switch and the input line, wherein the resistor is a high temperature resistor chip.

15. A motor vehicle having an internal combustion engine with an injector for injecting fuel, wherein the injector comprises:

an injector housing;

a movable nozzle needle that is arranged in the injector housing and has a nozzle needle tip; and a nozzle needle seat for receiving the nozzle needle tip, wherein a contact pairing of the nozzle needle and the nozzle needle seat forms a switch that adopts a closed state on a contact of the nozzle needle tip with the nozzle needle seat and an open state on an interruption of the contact;

the injector has an input line and an output line connected to an actuator, the actuator controlling a movement of the nozzle needle;

a ground connection comprising the switch, a first connector connected to the input line, and a second connector connected to a ground through the injector housing, and the ground connection reducing current in the output line when the switch is closed completing the ground connection; and a resistor is connected between the first connector of the switch and the input line, wherein the resistor is a high temperature resistor chip.

* * * * *